US009339852B1

(12) United States Patent
Campbell

(10) Patent No.: US 9,339,852 B1
(45) Date of Patent: May 17, 2016

(54) CRYSTAL DETAILER

(71) Applicant: Keith S. Campbell, East Kingston, NH (US)

(72) Inventor: Keith S. Campbell, East Kingston, NH (US)

( * ) Notice: Subject to any disclaimer, the term of this patent is extended or adjusted under 35 U.S.C. 154(b) by 69 days.

(21) Appl. No.: 14/251,218

(22) Filed: Apr. 11, 2014

(51) Int. Cl.
*B08B 3/02* (2006.01)
*B08B 3/04* (2006.01)
*B08B 11/00* (2006.01)

(52) U.S. Cl.
CPC ... *B08B 3/02* (2013.01); *B08B 3/04* (2013.01); *B08B 11/00* (2013.01); *B08B 2240/00* (2013.01)

(58) Field of Classification Search
None
See application file for complete search history.

(56) References Cited

U.S. PATENT DOCUMENTS 3,167,079 A * 1/1965 Weil ..... 134/137
5,220,933 A * 6/1993 Albers ..... 134/58 R
6,800,181 B1 * 10/2004 Accattato ..... 204/224 M
2013/0276822 A1 * 10/2013 Plavidal ..... B08B 3/04 134/3
2013/0306111 A1 * 11/2013 Myers ..... 134/32

* cited by examiner

*Primary Examiner* — Michael Barr
*Assistant Examiner* — Cristi Tate-Sims
(74) *Attorney, Agent, or Firm* — Nicholas Pfeifer; Ronald E. Smith; Smith & Hopen, P.A.

(57) ABSTRACT

An apparatus for cleaning items includes a container having a bottom wall, an open top, and an item-supporting screen formed in the bottom wall. A cleaning station has an open top and slideably receives the container. The container and cleaning station are in fluid communication with a remote vacuum source. A jet nozzle positioned inside the container is in fluid communication with a remote source of clean water and sprays clean water on the item upon activation of a pump. Ambient air for drying the item after cleaning is drawn into the container through an opening formed in a container lid and follows a path of travel that envelopes the item and dries the item when the remote source of vacuum is activated. The rate of flow of ambient air as well as the breadth of the flow is controlled by the size of the opening in the container lid.

18 Claims, 5 Drawing Sheets

CRYSTAL DETAILER

BACKGROUND OF THE INVENTION

1. Field of the Invention

This invention relates, generally, to devices that clean items such as chandelier crystals and jewelry. More particularly, it relates to a device that sprays hot water to clean the item, followed by drying the item with a flow of ambient air.

2. Description of the Prior Art

Due to the use of adhesives to bond crystals on jewelry, crystal figurines and the like, a new method of cleaning is needed. Currently there are two methods to professionally clean these items: 1) pressured steam and 2) ultrasonics.

The steam cleaning method is problematic because the heat of the steam softens the adhesives and presents a safety hazard when operating the equipment. Moreover, the pressure of the steam can detach the crystals.

The ultrasonic method is also problematic because the heat and cavitation can cause the bonds to weaken, break, or both. Chemicals used in current methods also weaken or break the adhesive bond. Finally both methods require a second step, i.e., drying with a cloth after cleaning. This drying method is limited to those surfaces where a cloth or fingers can fit. Accordingly, not all surfaces are dried.

However, in view of the art considered as a whole at the time the present invention was made, it was not obvious to those of ordinary skill in the art how the needed structure could be provided.

SUMMARY OF THE INVENTION

The long-standing but heretofore unfulfilled need for a device that cleans chandelier crystals, jewelry, figurines, and the like using only clean water and ambient air is now met by a new, useful, and non-obvious invention.

The inventive apparatus includes a portable cleaning plant that includes a clean water chamber adapted to hold clean water and a clean water pump having an inlet and an outlet submerged within the clean water. A heating element may also be submerged within the clean water when an application requires heated clean water.

The cleaning plant further includes a dirty water chamber adapted to hold dirty water, a vacuum chamber, and a vacuum pump positioned within the vacuum chamber. An opening interconnects the vacuum chamber and the dirty water chamber at a point above the level of the dirty water so that the dirty water chamber is under a vacuum when the vacuum pump is operating.

A container for holding an item to be cleaned has a bottom wall and sidewalls mounted about the bottom wall and projecting upwardly therefrom. An opening is formed in the bottom wall, preferably in the center thereof, and a screen is mounted in that opening. The screen supports the item to be cleaned.

The container is received within an upper end of a cleaning station which has a lower end in open communication with the vacuum pump.

More particularly, a vacuum hose has a first end in open fluid communication with the dirty water chamber and a second end in fluid communication with the lower end of the cleaning station.

A cleaning station has a funnel-like structure including an upper end and a lower end where a breadth of the upper end is greater than a breadth of the lower end. The upper end of the cleaning station slideably receives the container within a hollow interior of the upper end.

At least one water-discharging jet nozzle is secured to the upper end of the cleaning station in the hollow interior thereof. The at least one jet nozzle is aimed radially inwardly with respect to an axis of symmetry of the cleaning station. A clean water hose has a first end in open fluid communication with the outlet of the clean water pump and a second end in open fluid communication with the at least one water-discharging jet nozzle. An aperture formed in the cleaning station admits the at least one water-discharging jet nozzle into the hollow interior of the cleaning station and an aligned aperture formed in the container admits the at least one water-discharging jet nozzle into the hollow interior of the container.

The item to be cleaned is positioned in supported relation to the screen and at least one water-discharging jet nozzle discharges clean water that impinges against the item when the clean water pump is activated. The clean water pump is deactivated when the item is clean. The water pressure is regulated so that a higher psi can be used for tough cleanings and a lower psi can be used when cleaning fragile objects.

The item supported by the screen is dried after cleaning by ambient air drawn into the open top of the container. The ambient air follows a path of travel that envelopes and flows over the item when the vacuum pump is activated. The vacuum hose carries the ambient air and dirty water from said cleaning station to the dirty water chamber when the vacuum pump is activated.

In a first embodiment, a table has a first platform for supporting the container and the cleaning station and a second platform for supporting the cleaning plant. As aforesaid, the clean water hose provides fluid communication between the clean water in the clean water tank and the at least one jet nozzle and the vacuum hose provides fluid communication between the suction outlet of the vacuum pump in the cleaning plant and the lower end of the cleaning station.

In a first embodiment, an opening formed in the first platform has a breadth greater than the breadth of the lower end of the cleaning station and less than the breadth of the upper end so that the cleaning station upper end is supported by the opening when the lower end of the cleaning station is inserted through the opening.

In a second embodiment, a cleaning station opening is formed in a top wall of the dirty water chamber. The cleaning station opening has a breadth greater than the breadth of the lower end of the cleaning station and less than the breadth of the upper end so that the cleaning station upper end is supported by the cleaning station opening when the lower end of the cleaning station is inserted through the cleaning station opening.

As in the table top embodiment, the container is received within the hollow interior of the upper end of the cleaning station when the cleaning station is seated in the cleaning station opening. Accordingly, no vacuum hose is required in this second embodiment to provide fluid communication between the container-cleaning station and the suction inlet of the vacuum pump because the dirty water chamber is in open fluid communication with the vacuum chamber of the cleaning plant.

A lid is preferably associated with the container so that the rate of flow and the breadth of the flow of ambient air across the item supported by the screen can be controlled. If no lid is provided and the container is open-topped, then there is one rate of flow and one breadth of flow and such lidless embodiment is within the scope of this invention.

However, in the preferred embodiment, a lid is provided and an opening is formed in the lid to admit ambient air when the vacuum pump is activated.

The opening formed in the lid may have a large breadth relative to a breadth of the lid to admit ambient air into the container at a predetermined rate of flow when the vacuum pump is activated. The air flow travels over the item supported by the screen at the predetermined rate of flow and the breadth of the air flow has a breadth determined by the breadth of the opening.

In the alternative, the opening formed in the lid has a small breadth relative to a breadth of the lid. Air flow travels over the item supported by said screen at a predetermined rate of flow which is faster than the predetermined rate of flow associated with the opening having a large breadth. The breadth of the air flow is also narrower than the breadth associated with the large opening. Thus, when the same vacuum is applied, the rate of air flow is inversely proportional to the breadth of the opening because the rate increases as the breadth decreases. Under the same vacuum, the breadth of the air flow is directly proportional to the breadth of the opening because the breadth of the air flow narrows as the breadth of the opening decreases.

The container may have a square parallelepiped configuration and the cleaning station may have an upper end of square parallelepiped configuration of predetermined breadth that receives said container.

In the alternative, the container may have a cylindrical configuration and the cleaning station may have an upper end of cylindrical configuration of predetermined breadth that receives said cylindrical container. This advantageously enables a user to rotate the container with respect to the cleaning station. Such rotation also rotates the item supported by the screen and thus enables said item to be cleaned with clean water that impinges against it from varying angles as the container is rotated.

At least one arcuate slot is formed in the container bottom wall radially outwardly of the screen to accommodate the at least one jet nozzle when the container is rotated about its axis of symmetry relative to the cleaning station.

The cleaning station may have a lower end of predetermined breadth less than the breadth of the upper end. A breadth-reducing bevel may be formed between the upper and lower ends, thereby giving the cleaning station the appearance of a funnel. This shape is advantageous for mounting the container-cleaning station in an opening formed in a table top or in an opening formed in a top wall of the dirty water chamber as disclosed above, but such shape is not critical. It is advantageous because it enables a user to easily grasp the cleaning station lower end and to hold the cleaning station during the cleaning and drying procedure when the vacuum hose is used.

However, the cleaning station may also have a cylindrical shape from its upper end to its lower end, there being no breadth-reducing bevel formed therein. A flange is disposed mid-length thereof that engages the opening formed in the table top or the top wall of the dirty water chamber. Such structure could be more difficult to hold in one hand than the embodiment having a lower end of reduced size.

An important object of the invention is to facilitate the thorough cleaning of chandelier crystals, jewelry, figurines and the like in a short amount of time in the absence of chemicals.

Another important object is to provide such a cleaning apparatus in a small portable package that can be hand-carried.

Still another object is to provide such an apparatus with transparent parts so that an item to be cleaned can be placed into the apparatus in full view of its owner and the entire cleaning process can be observed in the full view of the owner.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1:
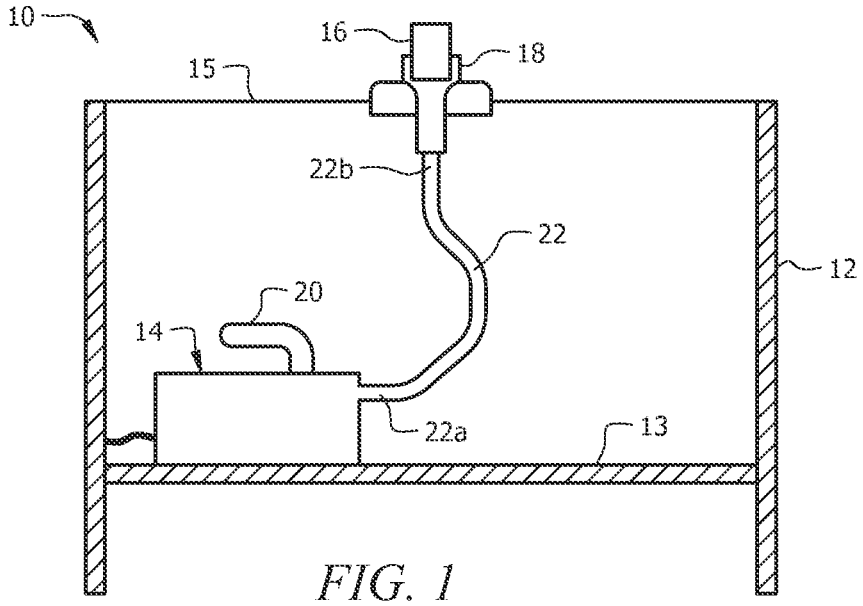
FIG. 1 is a diagrammatic side elevational view of the novel structure.

FIG. 1 depicts an illustrative embodiment of a novel structure which is denoted as a whole by the reference numeral 10. It includes table 12 having lower platform 13 for supporting cleaning plant 14 and top platform 15 for supporting cleaning container 16 and cleaning station 18. Cleaning container 16 is the container in which the crystals or other items are held and cleaned. It is removably inserted into cleaning station 18.

When a customer presents jewelry to be cleaned, a clerk removes container 16 from cleaning station 18 and opens container lid **16*a*. The customer places the jewelry into the hollow interior of the container, which is formed of a transparent material, and closes lid 16*a* which is also formed of a transparent material. The clerk or the customer then places container 16 into cleaning station 18 which is made of a transparent material as well. The clerk pushes a button and cleans the jewelry or other item in plain view of the customer. When the cleaning process is completed, the clerk separates container 16 from cleaning station 18 and opens lid 16*a*** so that the customer may retrieve the clean jewelry. Accordingly, the clerk does not touch the item at any stage of the procedure and the item remains within the view of the customer throughout the process.

Handle 20 of cleaning plant 14 is formed integrally or fixedly secured to said cleaning plant and enables it to be manually carried.

Figure 2:
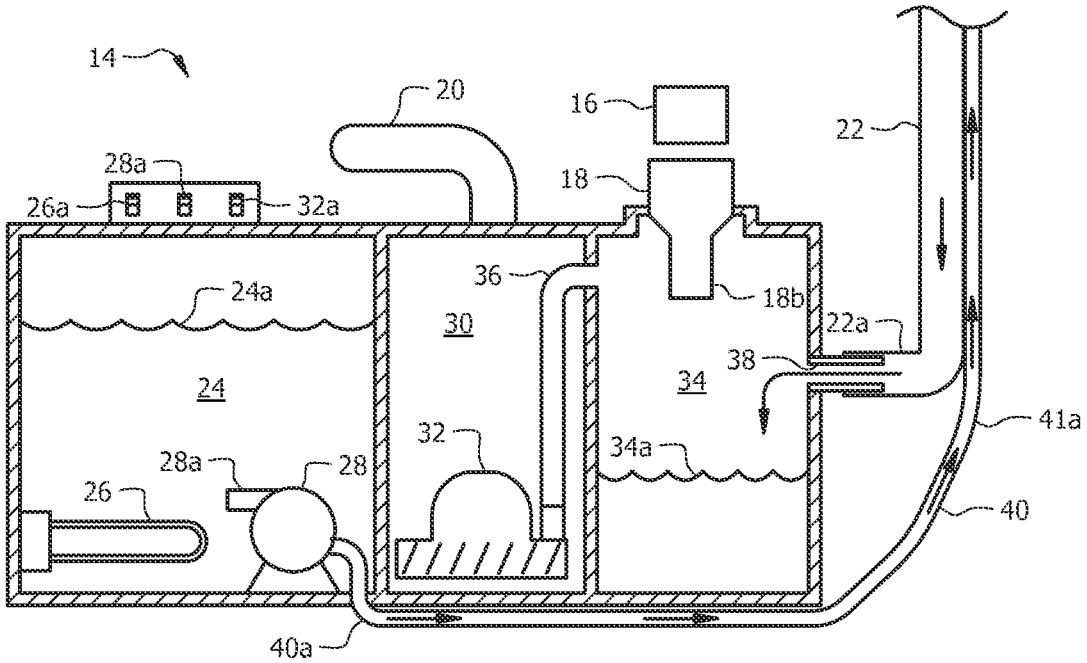
FIG. 2 is a diagrammatic side elevational view of the novel cleaning plant.

Flexible vacuum hose 22 provides fluid communication between the interior of cleaning plant 14 and the interior of cleaning station 18 and hence container 16 as best understood in connection with FIG. 2. Advantageously, the vacuum keeps the object being cleaned and its adhesives cool even though the water temperature is about one hundred sixty degrees (160°). This prevents the adhesives from becoming unbonded.

Novel cleaning plant 14 includes hot water tank 24 having water level **24*a*, immersed heating element 26 and immersed water pump 28 disposed therein, vacuum tank 30 having vacuum pump 32 positioned therewithin, and dirty water return tank 34 having water level 34***a* in this example.

Passageway 36 provides fluid communication between vacuum pump 32 and dirty water return tank 34. Vacuum hose 22 has proximal end 22*a* mounted to mounting nipple 38. Distal end 22*b* of said hose 22 is connected to container station 18 as depicted in FIG. 1.

Hot water tube 40 carries clean, hot water from hot water tank 24 to the hollow interior of container 16 as disclosed hereinafter in connection with FIG. 3. Hot water tube 40 has proximal end 40*a* in fluid communication with outlet 28*b* of water pump 28 and distal end 40*b* is disposed within the hollow interior of container 16 as depicted in said FIG. 3. Hot water tube 40 enters and exits vacuum hose 22 as drawn in FIGS. 2 and 3 to reduce snagging but tube 40 could remain outside of vacuum hose 22 as well.

Hot water tube 40 also delivers hot water to the hollow interior of container 16 when vacuum hose 22 is not needed, i.e., when container 18 is positioned on cleaning plant 14 in open fluid communication with vacuum tank 30.

Although FIG. 1 depicts container 16 and container station 18 mounted to top platform 15 of table 12, said container and station may also be mounted atop vacuum tank 34 as depicted in FIG. 2, i.e., container station 18 is removably mounted to platform 15 or dirty water return tank 34 and container 16 is removably mounted to said station in both configurations.

FIG. 2 also depicts switches 26*a*, 28*a*, and 32*a* mounted atop hot water tank 24. Said switches are on/off switches that activate and deactivate hot water heating element 26, water pump 28, and vacuum pump 32, respectively. Said switches may be mounted at any convenient location.

There is no requirement for container 16 and cleaning station 18 to have a particular configuration as long as they share a common configuration so that container 16 is slideably received within the hollow interior of cleaning station 18. As depicted in FIG. 3, both container 16 and cleaning station 18 have a square configuration.

Figure 3:
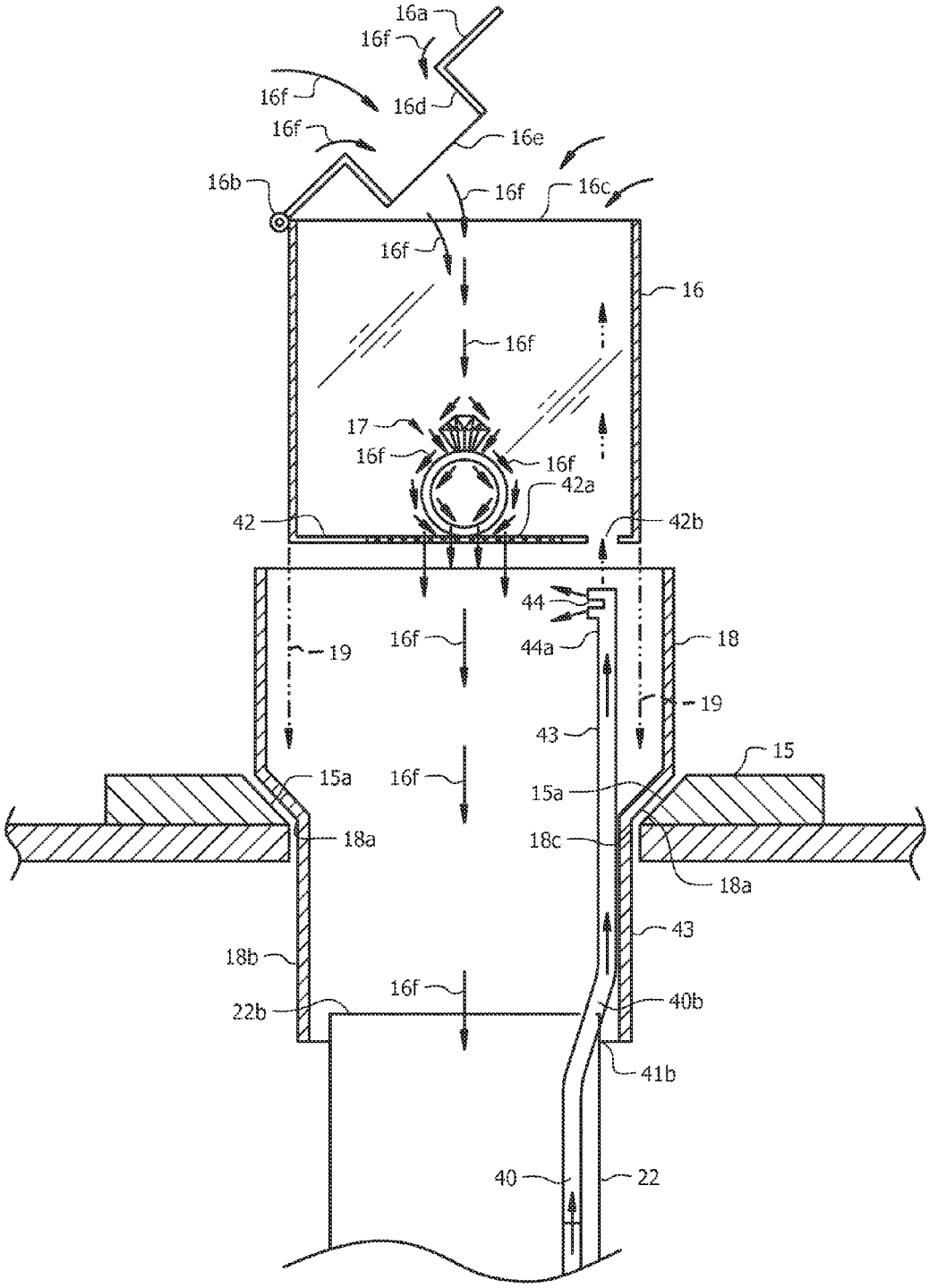
FIG. 3 is an exploded, side elevational view of the container and the cleaning station.

FIG. 3 is an exploded view and container 16 sits within the hollow interior of cleaning station 18 as indicated by assembly lines 19. A diameter-reducing bevel 18*a* is formed in cleaning station 18 about mid-length thereof. Bevel 18*a* is seated against opening 15*a* formed in table top 15 so that cleaning station 18 does not fall through said opening 15*a* and so that distal end 22*b* of vacuum hose 22 may engage the reduced diameter part 18*b* of cleaning station 18 that extends below opening 15*a*.

Bevel 18*a* may also be seated in an opening formed in the top of dirty water tank 34 as mentioned earlier in connection with FIG. 2.

Reduced diameter part 18*b* of cleaning station 18 may also be used as a handle so that cleaning station 18 and container 16 may be held by a user instead of table top 15 or dirty water tank 34. This allows a user to hold said container and cleaning station in any location, subject to the limitation that proximal end 22*a* of vacuum hose 22 is tethered to mounting nipple 38 as aforesaid.

In this particular embodiment, lid 16*a* is mounted by hinge 16*b* to rim 16*c* of container 16. Lid 16*a* could be flat with a central opening formed therein but reference numeral 16*d* indicates sidewalls that extend into the hollow interior of container 16 when lid 16*a* is closed and 16*e* indicates an opening formed in said lid to admit ambient air when vacuum pump 32 is activated.

Directional arrows 16*f* indicate air flow into the hollow interior of container 16 through opening 16*e*. The smaller arrows that follow the contour of jewelry item 17 are not numbered to avoid cluttering of the drawings but they are understood to be the same air flow and said air flow 16*f* continues after flowing over jewelry item 17 into reduced diameter part 18*b* of cleaning station 18 and into vacuum hose 22 and hence into dirty water tank 34 as depicted in FIG. 2.

Novel apparatus 10 cleans eye glasses, figurines, chandelier crystals and other such items, not being limited to jewelry items.

Lid 16*a* is optional because an item of jewelry such as item 17 in this illustrative example can be cleaned in the absence of lid 16*a*. However, the operation of crystal detailer 10 is enhanced by lid 16*a* because it substantially prevents water from splashing out of container 16 during a cleaning operation. Moreover, the rate at which air flows into the hollow interior of container 16 to impinge upon jewelry item 17 can be controlled by varying the size of opening 16*e*, i.e., a large opening such as would be provided in the absence of lid 16*a* results in a slower air flow rate and said air flow rate increases as the size of opening 16*e* decreases. Drying time is shortened as the flow rate of air increases.

Reducing the size of the opening not only increases the velocity of air through the opening, such size reduction also reduces the breadth of the column of air flowing onto the item being cleaned. Striking a crystal or item 17 with a narrow, fast moving column of air, as distinguished from a slower moving, broad column of air, tightens the air flow around the item and shortens the drying time. The shape of the opening may be any predetermined geometrical configuration.

The item being cleaned such as item 17 is supported at the bottom of container 16 by screen 42*a* formed in bottom wall 42 of container 16. Screen 42*a* supports the item being cleaned and allows air flow 16*f* to pass therethrough.

At least one opening 42*b* is formed in bottom wall 42 to admit a rigid hot water jet tube 43 which is in fluid communication with the distal end 40*b* of hot water tube 40. Rigid hot water jet tube 43 thus extends into the hollow interior of container 16. More particularly, hot water tube 40 enters into the hollow interior of vacuum tube 22 as at 41*a* in FIG. 2 and exits said hollow interior as at 41*b* in FIG. 3, near the interconnection of the distal end 22*b* of vacuum hose 22 and reduced diameter part 18*b* of cleaning station 18. Opening 18*c* is formed in bevel 18*a* to admit rigid hot water jet tube 43 into the hollow interior of cleaning station 18. Accordingly, as indicated by assembly lines 19, the upper part of said hot water jet tube 43 is positioned within the hollow interior of container 16 when said container is slideably received within the hollow interior of cleaning station 18 and said hot water jet tube is in fluid communication with hot water tube 40.

Hot water jet tube 43 terminates in hot water-emitting jet nozzle 44. Hot water 44*a* under pressure supplied by hot water pump 28 is therefore introduced into the hollow interior of container 16 where it strikes the item supported by screen 42*a* with force sufficient to knock dirt and grime therefrom. A continuous flow of ambient air 16*f*, pulled in by vacuum pump 32, thus works with said hot water to accomplish the cleaning. When item 17 is clean, hot water pump 28 is shut off. Vacuum pump 32 continues to operate after the shutdown of hot water pump 28 and is not shut off until item 17 has become dry as ambient air 16*f* flows over the various surfaces of said item 17.

Only one opening 18*c* and only one nozzle 44 is depicted in FIG. 3 but multiple openings 18*c* and multiple hot water jet tubes 43, each ending in a jet nozzle 44, are within the scope of this invention and are not depicted in FIG. 3 to avoid cluttering of that figure.

Figure 4:
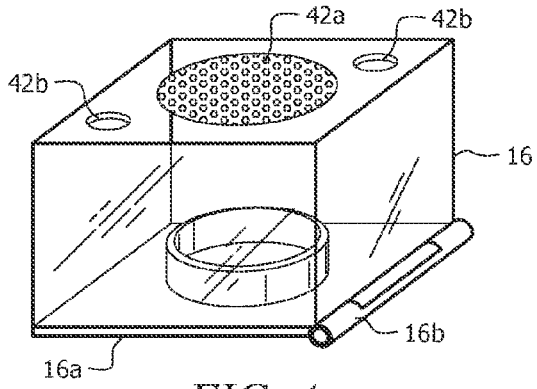
FIG. 4 is a perspective, bottom view of the container.

FIG. 4 provides a perspective view of the bottom of container 16. It depicts screen 42*a* and two (2) diagonally spaced apart openings 42*b* disposed on opposite sides of screen 42*a* for respectively receiving two (2) hot water jet tubes 43.

Figure 5:
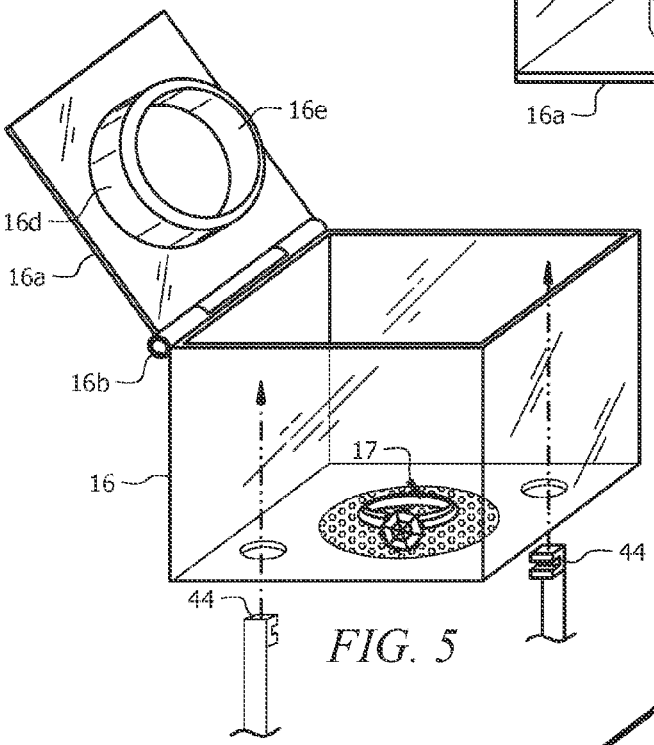
FIG. 5 is a perspective, top view of the container.

FIG. 5 provides a perspective view of the open upper end of container 16. Air inlet opening 16*e* in this particular embodiment is oval-shaped as depicted. Hinge 16*b* may be provided in any suitable hinge form, including a piano hinge. Lid 16*a* may also be releasably press fit into cleaning station 18 so that no hinge is required.

Figure 6:
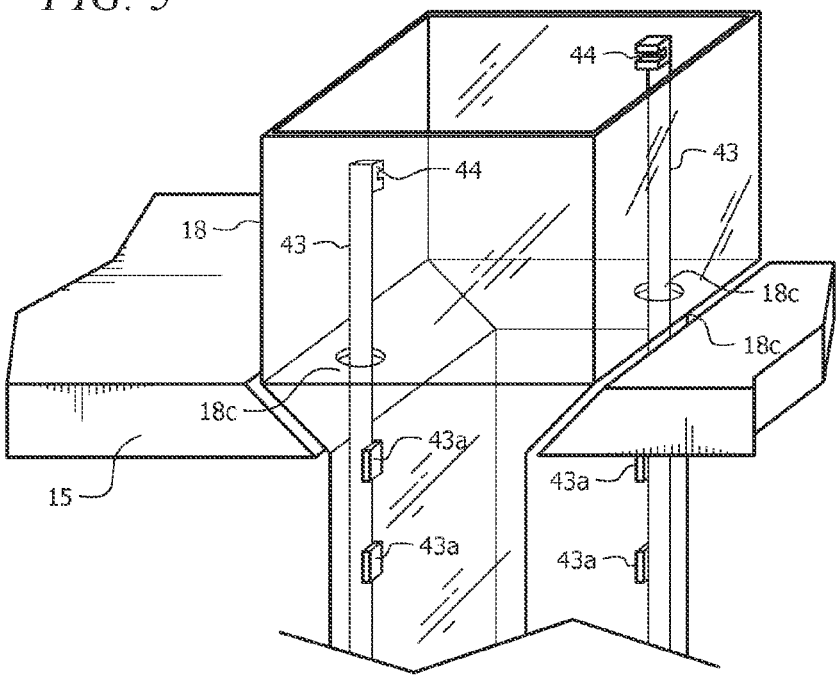
FIG. 6 is a side elevational view of the station base.

FIG. 6 depicts how a diametrically opposed pair of rigid hot water jet tubes 43 may be mounted to reduced diameter part 18*b* or cleaning station 18. In this example, the respective inboard sides of pads 43*a* are adhered to the exterior surface of said reduced diameter part 18*b* and said rigid hot water jet tubes 43 are adhered to the respective outboard sides of said pads.

Figure 7:
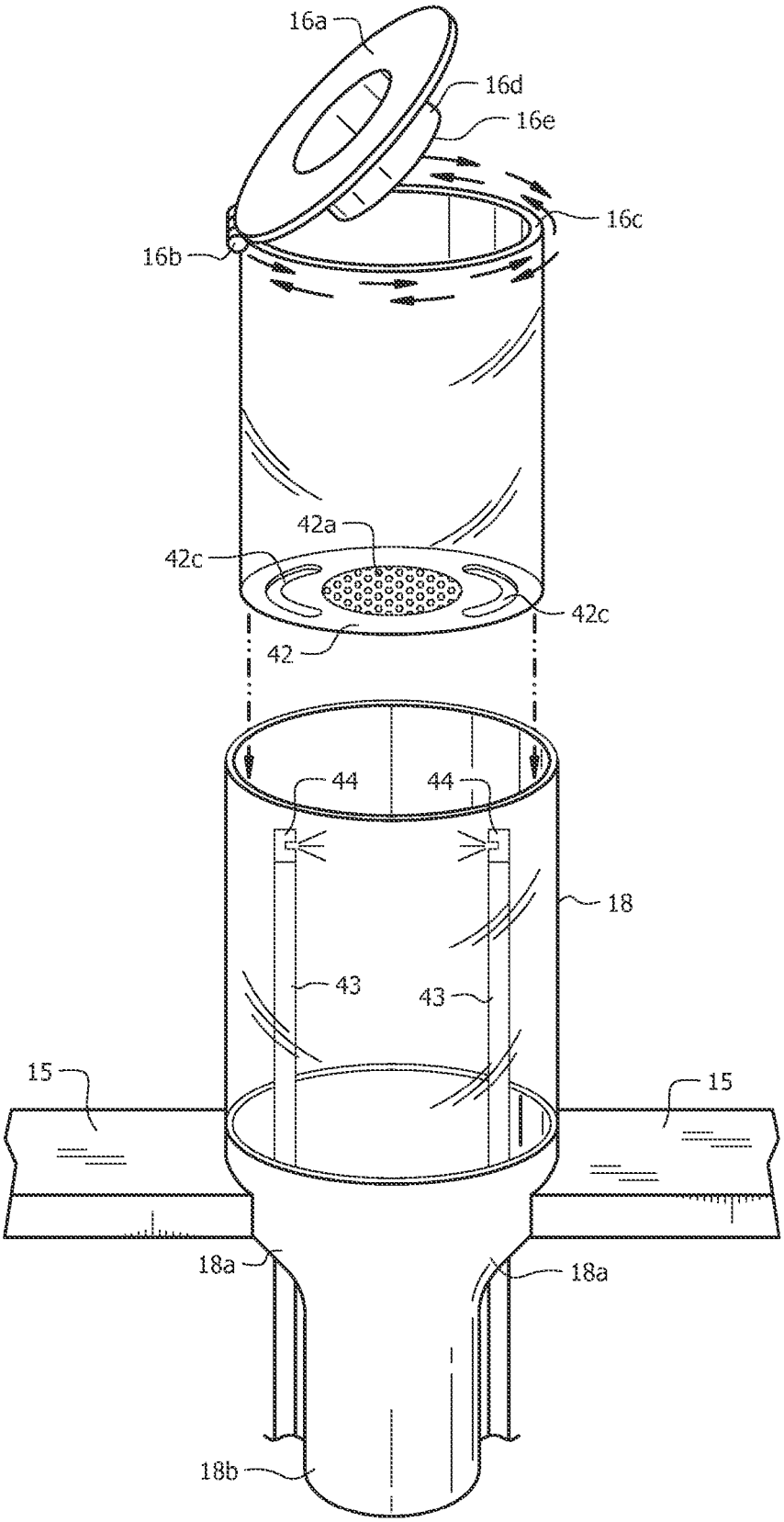
FIG. 7 is an exploded view of the container and cleaning station.
Figure 8:
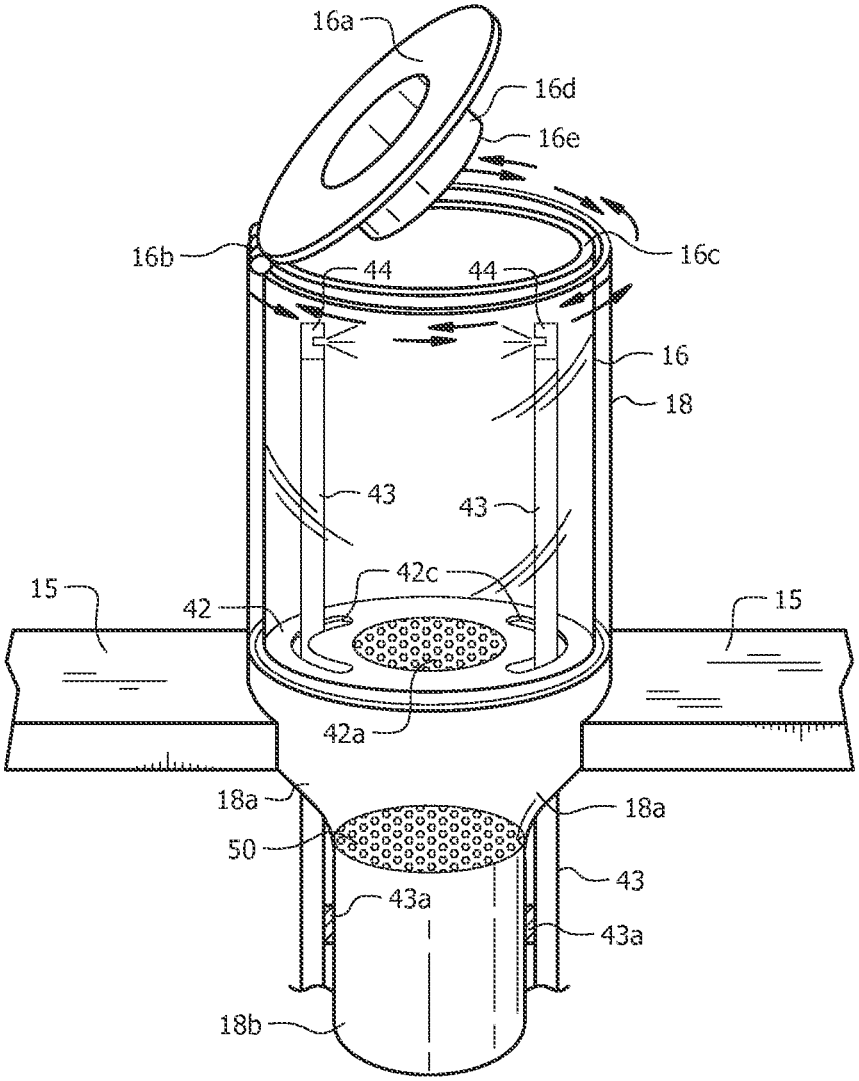
FIG. 8 is an assembled view of the parts depicted in FIG. 7.

FIGS. 7 and 8 depict container 16 and cleaning station 18 in exploded and assembled views, respectively, but with said parts having a cylindrical structure instead of the parallelepiped structure of FIGS. 3-6. This structure enables lid 16*a* to be rotatable in either direction about the vertical axis of symmetry of container 16 as indicated by a plurality of unnumbered directional arrows. It also allows container 16 to be rotatable about the same axis relative to cleaning station 18. Bottom wall 42 of container 16 thus is provided with arcuate slots 42*c* instead of apertures 42*b* to accommodate hot water jet tubes 43 when container 16 and cleaning station 18 are rotated about said axis relative to one another.

In a variation, one of the two hot water jet tubes may be connected to a source of soapy water so that the item within container 16 is sprayed with water from one jet nozzle 44 and soapy water from the other jet nozzle 44. Other such variations are within the scope of the invention as well, i.e., both jet nozzles could emit soapy water for a predetermined time period and then both could be switched to hot water for a predetermined time period. In difficult cases, various chemical cleaners could be applied as well in various combinations of hot water, soapy water, and chemicals.

Since both container 16 and cleaning station 18 are cylindrical, container 16 can slide up and down relative to cleaning station 18 and can also be rotated in either direction three hundred sixty degrees (360°) about its vertical axis of symmetry relative to cleaning station 18 and therefore relative to jet nozzles 44. This gives the user additional flexibility in the positioning of the item to be cleaned relative to said jet nozzles.

As depicted in FIG. 8, backup screen 50 is positioned in reduced diameter part 18*b* of cleaning station 18 to capture any loose parts of the cleaned item that may fall through screen 42*a* or through slot 42*c*.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An apparatus for cleaning chandelier crystals, jewelry, and the like, comprising:

a clean water chamber adapted to hold clean water therewithin;

a clean water pump having an inlet and an outlet submerged within said clean water;

a container having a bottom wall and sidewalls mounted about the bottom wall and projecting upwardly therefrom;

an opening formed in said bottom wall and a screen mounted in said opening;

a cleaning station having a funnel-like structure including an upper end and a lower end where a breadth of said upper end is greater than a breadth of said lower end and includes a smooth taper between the breadth of the upper end and the breadth of the lower end;

said upper end of said cleaning station slideably receiving said container within a hollow interior of said upper end;

a dirty water chamber adapted to hold dirty water;

a vacuum chamber;

a vacuum pump positioned within said vacuum chamber, said vacuum chamber being in open fluid communication with said dirty water chamber;

a vacuum hose having a first end in open fluid communication with said dirty water chamber and a second end in fluid communication with said lower end of said cleaning station;

a clean water hose having a first end in open fluid communication with said outlet of said clean water pump;

at least one water-emitting jet nozzle secured to said upper end of said cleaning station in said hollow interior thereof;

said clean water hose having a second end in open fluid communication with said at least one water-discharging jet nozzle;

an aperture formed in said cleaning station to admit said at least one water-emitting jet nozzle into said hollow interior of said cleaning station;

an aperture formed in said container to admit said at least one water-emitting jet nozzle into said hollow interior of said container;

said item to be cleaned positioned in supported relation to said screen mounted in said opening formed in said bottom wall of said container;

said at least one water-discharging jet nozzle discharging water that impinges against said item supported by said screen when said clean water pump is activated, said clean water pump being deactivated when said item is clean;

said item supported by said screen being dried by ambient air drawn into said open top of said container and following a path of travel that envelopes and flows over said item when said source of vacuum is activated;

said vacuum hose carrying said ambient air and dirty water from said cleaning station to said dirty water chamber when said source of vacuum is activated.

2. The apparatus of claim 1, further comprising:

a cleaning plant formed by said clean water chamber, said vacuum chamber, and said dirty water chamber;

a table having a first platform for supporting said container and said cleaning station;

said cleaning station having a funnel-like structure including an upper end and a lower end where a breadth of said upper end is greater than a breadth of said lower end;

an opening formed in said first platform, said opening having a breadth greater than said breadth of said lower end of said cleaning station and less than said breadth of said upper end so that said cleaning station upper end is supported by said opening when said lower end of said cleaning station is inserted through said opening;

said table having a second platform for supporting said cleaning plant.

3. The apparatus of claim 2, further comprising:
said dirty water chamber having a top wall and a dirty water chamber opening formed in said top wall;
said dirty water chamber opening having a breadth greater than said breadth of said lower end of said cleaning station and less than said breadth of said upper end so that said cleaning station upper end is supported by said dirty water chamber opening when said lower end of said cleaning station is inserted through said dirty water chamber opening;
said container being received within said hollow interior of said cleaning station when said cleaning station is seated in said dirty water chamber opening;
whereby no vacuum hose is required to provide fluid communication between said container and cleaning station and said source of vacuum.

4. The apparatus of claim 3, further comprising:
a lid associated with said container;
said lid having an opening formed therein to admit ambient air when said source of vacuum is activated.

5. The apparatus of claim 4, further comprising:
said opening formed in said lid having a large breadth relative to a breadth of said lid to admit ambient air into said container at a predetermined rate of flow when said vacuum source is activated;
whereby air flow travels over said item supported by said screen at said predetermined rate of flow; and
whereby said air flow has a breadth determined by the breadth of said opening.

6. The apparatus of claim 4, further comprising:
said opening formed in said lid having a small breadth relative to a breadth of said lid to admit ambient air into said container at a predetermined rate of flow when said vacuum source is activated;
whereby air flow travels over said item supported by said screen at said predetermined rate of flow; and
whereby said air flow has a breadth determined by the breadth of said opening.

7. The apparatus of claim 1, further comprising:
said container having a square parallelepiped configuration;
said cleaning station having an upper end of square parallelepiped configuration of predetermined breadth, a lower end of predetermined breadth less than said breadth of said upper end, and a breadth-reducing bevel formed between said upper and lower ends;
said upper end of said cleaning station slideably receiving said container;
whereby said cleaning station is supported by an opening in a support surface having less breadth than the breadth of said upper end and more breadth than the breadth of said lower end.

8. The apparatus of claim 7, further comprising:
said opening formed in a table top.

9. The apparatus of claim 7, further comprising:
said opening formed in a top wall of said dirty water chamber.

10. The apparatus of claim 7, further comprising:
said lower end adapted to be hand-held.

11. The apparatus of claim 1, further comprising:
said container having a cylindrical configuration;
said cleaning station having a cylindrical upper end of predetermined diameter, a cylindrical lower end of predetermined diameter less than said diameter of said cylindrical upper end, and a diameter-reducing bevel formed between said upper and lower ends;
said upper end slideably receiving said container;
whereby said cleaning station is supported by a circular opening in a support surface having less diameter than the diameter of said upper end and a greater diameter than the diameter of said lower end.

12. The apparatus of claim 11, further comprising:
said opening formed in a table top.

13. The apparatus of claim 11, further comprising:
said opening formed in a top wall of said dirty water chamber.

14. The apparatus of claim 11, further comprising:
said lower end adapted to be hand-held.

15. The apparatus of claim 11, further comprising:
said container being rotatable with respect to said cleaning station;
whereby rotation of said container with respect to said cleaning station enables a user to rotate said container so that said item supported by said screen may be impacted by clean water discharged by said jet nozzles from an infinite number of positions of rotational adjustment.

16. The apparatus of claim 15, further comprising:
at least one arcuate slot formed in said screen to accommodate said at least one jet nozzle when said container is rotated about its axis of symmetry relative to said cleaning station.

17. The apparatus of claim 2, further comprising:
an elongate hose having a first end disposed in open fluid communication with an outlet of said clean water pump and a second end disposed in open fluid communication with said at least one jet nozzle so that activation of said clean water pump causes water to be discharged by said at least one jet nozzle.

18. The apparatus of claim 17, further comprising:
a vacuum hose having a first end disposed in open fluid communication with said suction inlet of said vacuum pump and a second end disposed in open fluid communication with said lower end of said container so that activation of said vacuum pump causes ambient air to flow through said container lid opening, over said item supported by said screen, through said screen, and to said suction inlet through said vacuum hose and further causes water discharged by said at least one jet nozzle to flow into said dirty water chamber.

* * * * *